United States Patent [19]

Herpich et al.

[11] 4,180,365

[45] Dec. 25, 1979

[54] HYDRAULIC SYSTEM FOR A REFUSE TRUCK

[75] Inventors: William A. Herpich; George W. Palmer, both of Galion, Ohio

[73] Assignee: Peabody International Corporation, Galion, Ohio

[21] Appl. No.: 902,338

[22] Filed: May 3, 1978

[51] Int. Cl.[2] ..... B65F 3/20

[52] U.S. Cl. ..... 414/525

[58] Field of Search ..... 414/472, 525

[56] References Cited

U.S. PATENT DOCUMENTS

| | | | |
|---|---|---|---|
| 3,615,028 | 10/1971 | Appleman et al. | 414/525 |
| 3,767,068 | 10/1973 | Herpich et al. | 414/525 |

*Primary Examiner*—Robert G. Sheridan

*Attorney, Agent, or Firm*—Henry K. Leonard

[57] ABSTRACT

An apparatus for compacting refuse as in the body of a rear loader refuse truck having a movable panel which extends across the body as a barrier against which the refuse is compacted by a packer blade. The packer blade is movable through a loading hopper to move the refuse into the rear of the body and to compact it against the panel. The apparatus has an hydraulic system including a pump for supplying fluid at a controlled maximum system pressure, an hydraulic cylinder mechanism for powering the packer blade and a valve which is biased toward neutral and which is manually movable to a power position for supplying fluid to the hydraulic cylinder. The valve has pressure responsive means which hold it in power position and which are deactivated when the pressure in the hydraulic cylinder reaches a level below maximum system pressure. The apparatus comprises a manually activated, position sensing device, for example an engageable cam, which can be set to overcome the pressure responsive means and to hold the valve in power position. An element of the packer blade structure deactivates the position sensing cam when the packer blade reaches a position close to but short of its normal final rest position which allows the bias on the valve to return it to neutral and to stop the movement of the packer blade.

10 Claims, 6 Drawing Figures

HYDRAULIC SYSTEM FOR A REFUSE TRUCK

BACKGROUND OF THE INVENTION

A rear loading refuse truck of the type disclosed, for examples, in U.S. Pat. Nos. 3,767,068, 3,777,917 and 4,029,224, usually has an ejection panel mounted within the body of the truck which is powered to move back and forth as necessary, first to act as a bulkhead against which refuse can be packed and compacted and secondly to act as an ejector for pushing the refuse out of the body of the truck after it is loaded. In such a truck a rear tail gate is provided which has a refuse accumulation hopper at its bottom and a packer blade which is cycled to move through a closed path from a position in which the packer blade closes off the rear of the body, backwardly over accumulated refuse in the hopper and downwardly through the hopper to carry the refuse forwardly out of the hopper and to pack it into the rear of the body, compressing it as much as possible against the ejection panel.

Most vehicles of this type have hydraulic systems including hydraulic cylinders and piston rods which actuate the packer blade. The cylinders are controlled by sequentially operated spool valves which are provided with pressure responsive release means to deactivate them to neutral if the pressure in the connected lines reaches a predetermined level. In order to obviate possible malfunction resulting from shock pressure, pressure surges and the like, the pressure responsive relief means are set at levels lower than maximum system pressure. For example, with a maximum system pressure of 2000 p.s.i., the pressure responsive means might be set at 1700–1800 p.s.i. and if there is a second valve in a "down stream" connection, it should be set 200–300 p.s.i. lower.

Because of the necessity of building into such a system a pressure relief means, if the pressure exerted by the refuse trapped between the packer blade and the ejection panel reaches a level of 1700 p.s.i., the pressure responsive mechanism functions and the packer blade stops. Sometimes this position is reached before the packer blade has returned to its rest position closing the rear of the body and often the operator will over-control the pressure responsive mechanism, as by holding a feeding valve closed, in an effort to apply to the refuse the full 2000 p.s.i. In many cases, this application of the full pressure delivered by the pump to the system is sufficient to carry the packer blade to its rest position thus further compacting the refuse in the space between it and the ejection panel. However, if this extra manual operation is required the operator must remain at the truck. This means that that the operator cannot otherwise be getting containers of refuse and dumping them into the refuse hopper.

It is, therefore, the principal object of the instant invention to provide an hydraulic apparatus for a rear loading refuse truck, or the like, which is not only provided with a pressure responsive relief system for ordinary protection of the system but also has what might be called a "system hold" mechanism which is responsive to the position of the packer blade relative to the loading hopper and the truck body and not merely to the pressure created in the system.

It is yet another object of the instant invention to provide an hydraulic system for a rear loading refuse truck, or the like, in which the control valves for the packing cycle of the packer blade are held in power position during the movement of the packer blade through the hopper and up toward the ejection panel in the truck body until the packer blade reaches a position very close to but slightly short of its final rest position so as to apply to the blade during the packing stroke the full power potential of the hydraulic system even through it may momentarily pass the usual pressure responsive cut off.

DESCRIPTION OF PREFERRED EMBODIMENT

Figure 1:
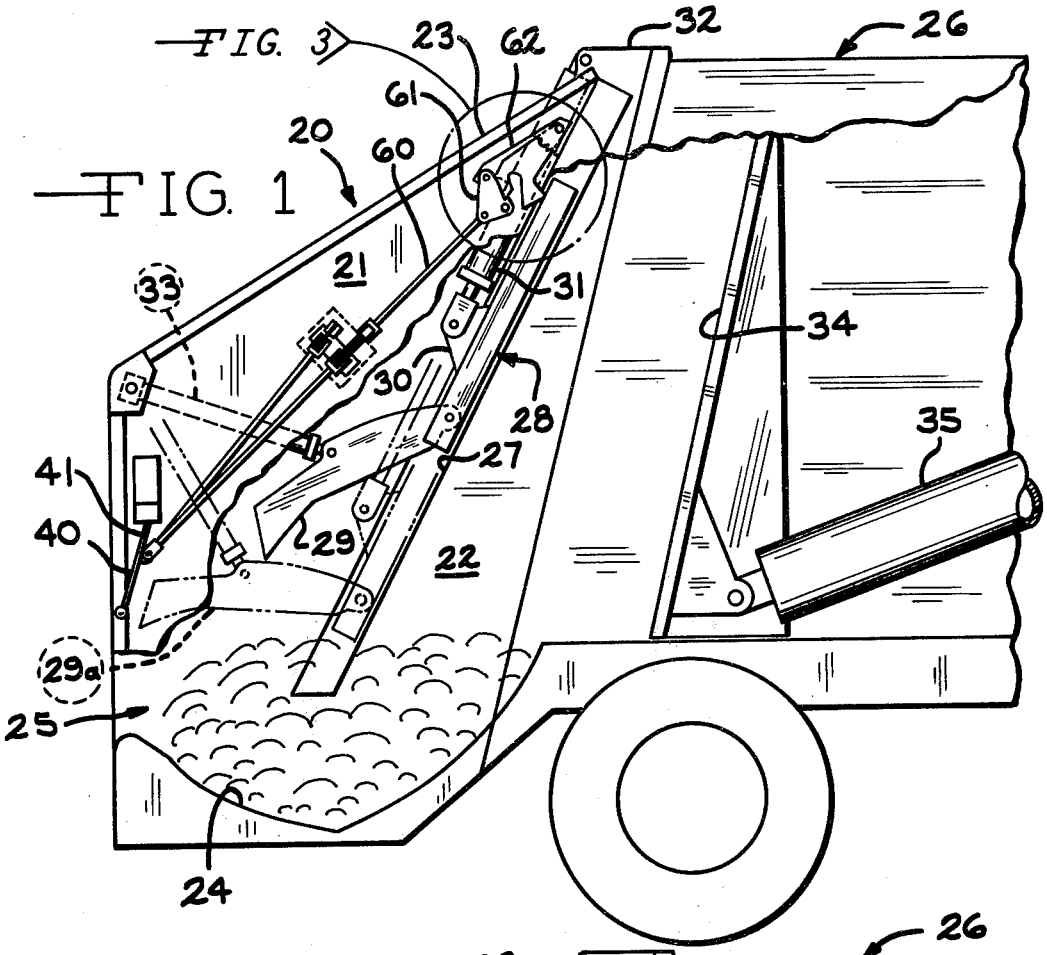
FIG. 1 is a greatly simplified and fragmentary view in side elevation, with parts broken away of a rear loading refuse truck showing the ejection panel and the packer blade as equipped according to the instant invention.
Figure 2:
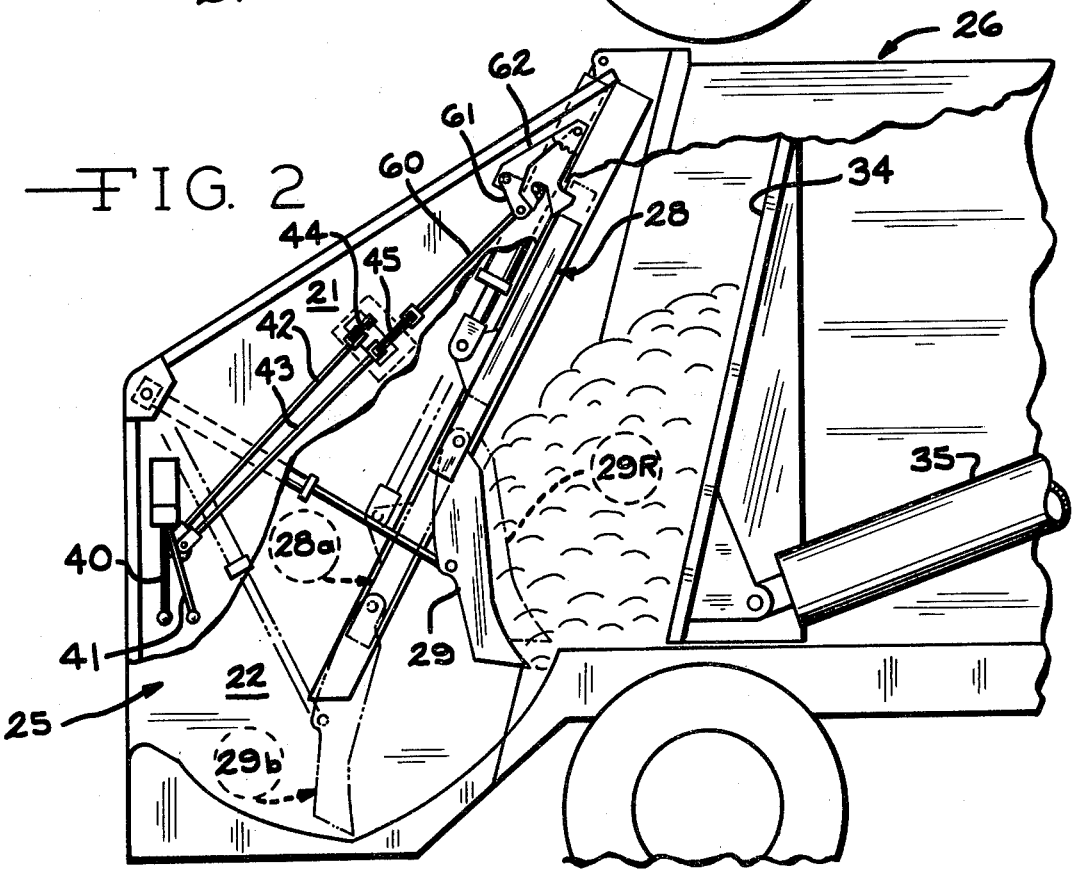
FIG. 2 is a view similar to FIG. 1 but showing the packer blade at substantially the end of its packing movement, i.e., as it approaches close to its rest position at the rear of the body of the refuse vehicle.

A tailgate for a rear loading refuse vehicle of the type generally indicated in FIGS. 1 and 2 is more completely described in Herpich et al U.S. Pat. No. 4,029,224 of June 14, 1977. The tail gate, generally indicated by the reference number 20, has vertical side walls 21 and 22, a roof 23 and a hopperlike bottom 24. The side walls 21 and 22 and the bottom 24 define a rear opening, generally indicated by the reference number 25, through which the operators dump refuse into the bottom 24. The tailgate 20 is mounted on the rear of a body 26 of a refuse vehicle only fragmentarily shown in FIGS. 1 and 2. Other structural members of the tail gate 20 and its manner of mounting on the rear of the body 26 are fully described in the reference patent and will not be further described here.

Each of the side walls 21 and 22 have an upwardly and forwardly inclined guide track 27 and a generally rectangular slide block 28 is mounted in each of the guide tracks 27, the slide blocks 28 being connected to each other by horizontal members, not shown, and serve to pivotally mount a packer blade 29 which extends across between the side walls 21 and 22 of the tail gate 20. Each of the slide blocks 28 has an upwardly and rearwardly extending ear 30 to which the rod of a packing cylinder 31 is connected, the upper ends of the cylinders 31 being pivotally connected to massive ears 32 at the top of the tail gate 20. By alternately extending and retracting the rods of the cylinders 31, the slide blocks 28 are slid up and down in their tracks 27 from an uppermost position as illustrated in FIG. 1 to a lowermost position as shown in FIG. 1 in broken lines indicated by the reference number 28*a*.

Two sweep cylinders 33 are pivotally connected at their bases to the upper rear corners of the tail gate 20 and their rods are pivotally connected to the packer blade 29 intermediate its upper pivoted end and its lower free end.

By alternate actuation of the packing cylinders 31 and the sweep cylinders 33, under control of the hydraulic system and its valves as will be more fully described below, the packer blade 29 is moved through a closed path as follows:

(a) from a rest position indicated by the reference No. 29R slightly above and to the right of the position shown in solid lines in FIG. 2, by retraction of the sweep cylinders 33;

(b) to an intermediate position shown in broken lines in FIG. 1 indicated the reference No. 29*a*, by extension of the packing cylinders 31;

(c) to a position at the bottom of the loading hopper 24 as shown in broken lines in FIG. 2 indicated by the reference No. 29*b* by extension of the sweep cylinders 33.

(d) back and up to, or close to, the rest position 29R as shown in solid lines in FIG. 2 by retraction of the packing cylinders 31.

During the fourth step of the cycle as described in sub-paragraph (d) above, refuse previously dumped into the hopper 24 is picked up by the packer blade 29 and pushed upwardly and forwardly into the rear open end of the truck body 26 against a movable ejector panel generally indicated by the reference number 34. The ejector panel 34 is movable back and forth in the body 26 by a massive hydraulic cylinder 35.

During each cycle of the packer blade 29 the ejector panel preferably is maintained in a position in the body 26 so that the movement of the packer blade in its last quadrant not only pushes the refuse out of the hopper 24 into the body 26 but also compacts it against the panel 34 crushing objects, such as cardboard cartons and the like, with the force exerted by the packing cylinders 31 as they pull the packer blade 29 upwardly from the broken line position in FIG. 2 to the solid Line position in that figure. As successive hopper loads of refuse are packed into the rear of the body 26, the ejector panel 34 is gradually moved toward the front of the body 26 so as to continue to present a "bulkhead" against which the packer blade 29 may compact and crush the refuse.

Figure 5:
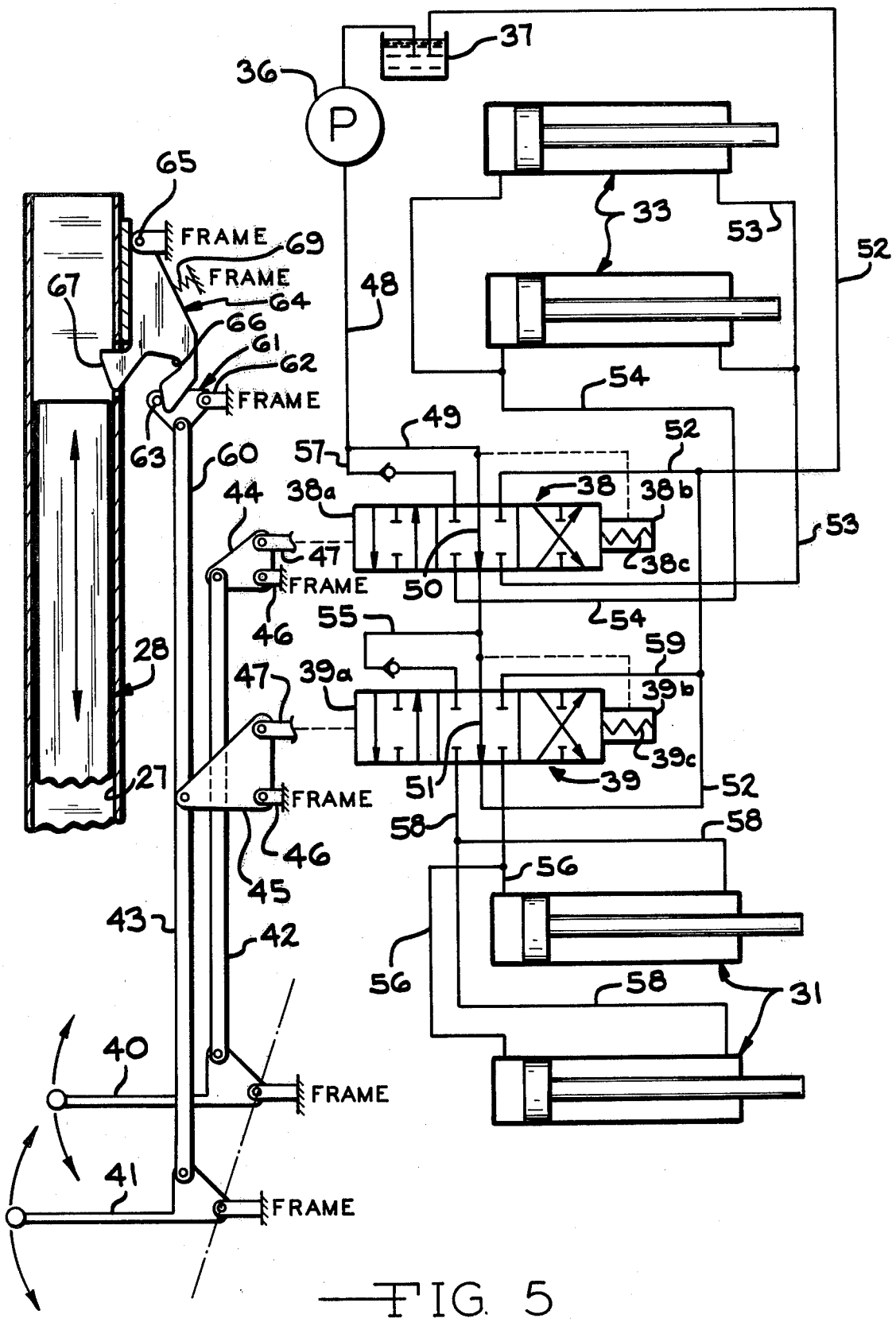
FIG. 5 is a schematic hydraulic circuit and a simplified showing of a "system hold" mechanism for the actuation and control of a packer blade through its packing cycle according to the invention.

Referring now to FIG. 5, the hydraulic means comprises a pump 36 to supply hydraulic fluid at a controlled maximum pressure, say 2000 p.s.i., a tank 37 and a pair of spool valves 38 and 39 which may be identical. Each of the valves 38–39 has a movable spool 38*a* or 39*a*, a pressure responsive detent means 38*b* or 39*b* and a centering spring 38*c* or 39*c*. The detent means 38*b*–39*b* functions to hold the respective spool 38*a*–39*a* in either its left or right position, as the case may be, until the hydraulic pressure in the lines fed by the pump 36 reaches a preset level so that the detent means 38*b*–39*b* releases the respective one of the spools 38*a*–39*a* and the centering springs (38*c*–39*c*) restores the associated spool to the neutral position.

Each of the spools 38*a*–39*a* is moved from the neutral position of FIG. 5 either to the left or to the right by one of a pair of handles 40 and 41. In FIG. 5 the handles 40–41 are shown offset from each other and as being pivotally mounted by elements labeled "FRAME". However, as can be seen in FIGS. 1 and 2, the handles 40–41 actually would be mounted on the same center on the side wall 21. Other fixed mounting elements shown in FIG. 5 also are labeled "FRAME". The handles 40–41 are connected by links 42 or 43 to bell cranks 44 or 45 which are pivotally mounted on ears 46 and are connected by short tie links 47 to the spools 38*a*–39*a* of the valves 38–39.

With the packer blade 29 in its rest position, if the pump 36 is running, hydraulic fluid flows from the pump 36 through a line 48, a branch line 49, and a central passage indicated by the arrow 50 in the valve 38. The fluid then flows through an open central passage in the valve 39 indicated by the reference No. 51, and via a line 52 returns to the tank 37.

When it is desired to initiate a packing cycle and to start the packer blade 29 away from its rest position, the operator swings both of the handles 40–41 in a counterclockwise direction (FIG. 5) pulling the two valve spools 38*a*–39*a* to the left. Movement of the spools 38*a*–39*a* to the left closes off the central passages 50–51 of the valves 38–39 and establishes two hydraulic circuits as follows:

(1) Hydraulic fluid from the pump 36 in the lines 48 and 49 now flows through the valve 38 to a hydraulic line 53 to the rod ends of the two sweep cylinders 33 causing them to retract and pull the packer blade 29 from the rest position backwardly and upwardly to the position shown in solid lines in FIG. 1.

(2) The base ends of the sweep cylinders 33 are connected by an hydraulic line 54 through the valve 38 to the line 52 and to the tank 37 which allows the hydraulic fluid behind the pistons of the cylinders 33 to dump.

Upon completion of the retraction of the cylinders 33, pressure in the lines 48, 49 and 53 reaches the level at which the detent means 38*b* has been set, the spool 38*a* is released and immediately is returned to neutral by the centering spring 38*c*.

Upon restoration of the spool 38*a* to the neutral position shown in FIG. 5 hydraulic fluid then can flow through the valve 38, a branch passage 55 and through valve 39, to a line 56 to the bases of the packing cylinders 31 to cause them to extend. Extension of the packing cylinders 31 moves the slides 28 downwardly in the tracks 27 moving the slides and the packer blade 29 to the broken line position 29*a* shown in FIG. 1. During the extension of the packing cylinders 31, fluid from the rod ends flows through a line 57 and the valve 39 to a branch 58 of the return line 52 and to the tank 37. When the extension of the packing cylinders 31 has been completed, the pressure in the then connected hydraulic circuit reaches a maximum level at which the detent means 39*b* has been preset and the spool 39*a* is released and centered by the spring 39*c*.

At this point in the cycle of the packer blade 29, both of the valves 38 and 39 have been returned to neutral and, through the linkages set up above, the two handles 40–41 are returned to their intermediate position. The entire mechanism stops and the hydraulic fluid then recirculates through the central passages 50–51 in the pathway described above back to the tank 37.

During these two first quadrants of the movement of the packer blade 29 the operator can continue to throw refuse into the hopper 24 without fear of being injured by the packer blade and, when the movement of the machinery comes to a halt he can determine whether or not sufficient refuse has been placed into the hopper to indicate that it should then be moved into the body 26 and packed against the panel 34.

In order to complete the packing cycle, the operator next swings both of the handles 40 and 41 in a clockwise direction from the position shown in FIG. 5 which, through the medium of the linkages already described, shifts the valve spools 38*a*–39*a* to the right from their neutral position. This feeds power fluid from the pump 36 through the line 48 and a branch line 57 to the valve 38 and, through the valve 38 to the line 54 and to the bases of the sweep cylinders 33. The sweep cylinders 33 extend to move the packer blade 29 from the broken line position 29*a* (shown in FIG. 1) to the broken line position 29*b* (shown in FIG. 2). During this movement the refuse in the hopper 24 is scooped forwardly by the blade 29. Hydraulic fluid trapped in the rod end of the sweep cylinders 33 is forced out through the line 53 and the valve 38 to the return line 52 to the tank 37.

As soon as the sweep cylinders 33 reach their full extension, pressure in the hydraulic lines 48,57 and 54 reaches the maximum level at which the detent means 38*b* has been set and the spool 38*a* is released, being restored to neutral position by the spring 38*c*.

As soon as the valve spool 38*a* reaches neutral fluid flows through the line 55 and, through the valve 39 and a line 57 to the rod ends of the packing cylinders 31 causing them to retract. Retraction of the packing cylinders 31 moves the slide blocks 28 up the guide tracks 27 pulling the packer blade 29 from the broken line position (29*b* in FIG. 2) toward its rest position at the rear of the vehicle body 26. During this movement hydraulic fluid in the base ends of the packing cylinders 31 is forced outwardly through the line 56 and the valve 39 to a line 59 and then by the line 52 is returned to the tank 37.

Were it not for the position sensing means constituting a part of the instant invention, the retraction movement of the packing cylinders 31 just described would continue until the packing cylinders 31 were fully retracted or the hydraulic pressure in the lines built up to the level at which the detent pressure sensing means 39*b* would release the valve spool 39*a* allowing it to be restored to neutral by the centering springs 39*c* and the mechanism would come to a stop.

"SYSTEM HOLD" MECHANISM

However, in accordance with the instant invention, the handle 41 which actuates the valve spool 39*a* also is connected by an extension link 60 to a rocker 61 (see also FIGS. 3 and 4) that is pivotally mounted by spaced bracket plates 62 near the upper end of the guide track 27. The rocker 61 mounts a latch pin 63 which is positioned to be engaged by a latch plate 64. The latch plate 64 is pivoted on a cross pin 65 and has a pin receiving notch 66 and a cam surface 67. The cam surface 67 extends through a slot 68 in the upper wall of the track 27 into position where it will be engaged by the upper end of one of the slides 28 when the mechanism reaches the position shown in solid lines in FIG. 2 and the packer blade 29 is approaching but not quite at its rest position 29R.

Figure 3:
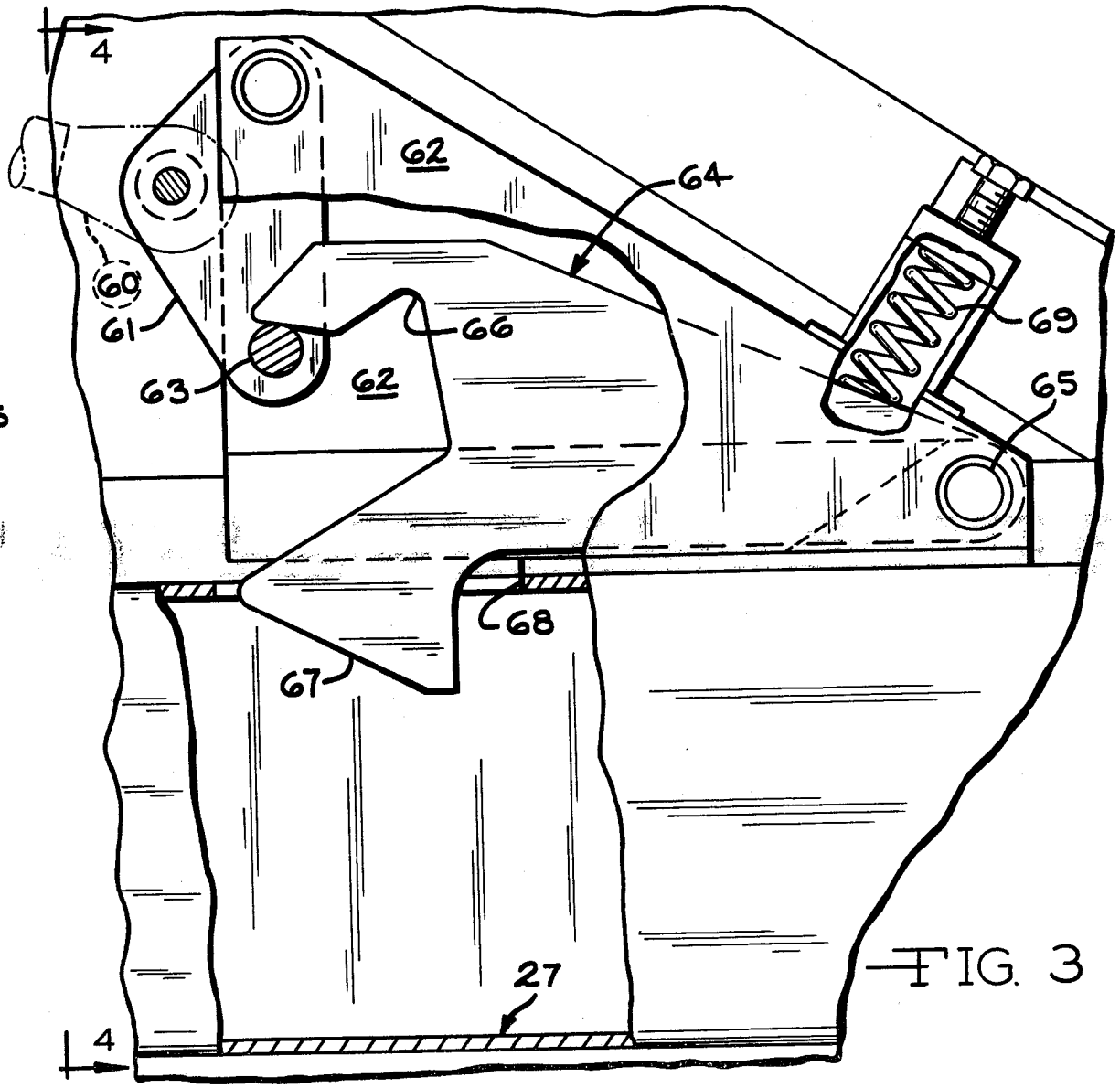
FIG. 3 is a greatly enlarged, fragmentary view, partly in elevation and partly in section, and with parts broken away, of a portion of FIG. 1 generally enclosed within the small circle indicated by the number FIG. 3 in FIG. 1.
Figure 4:
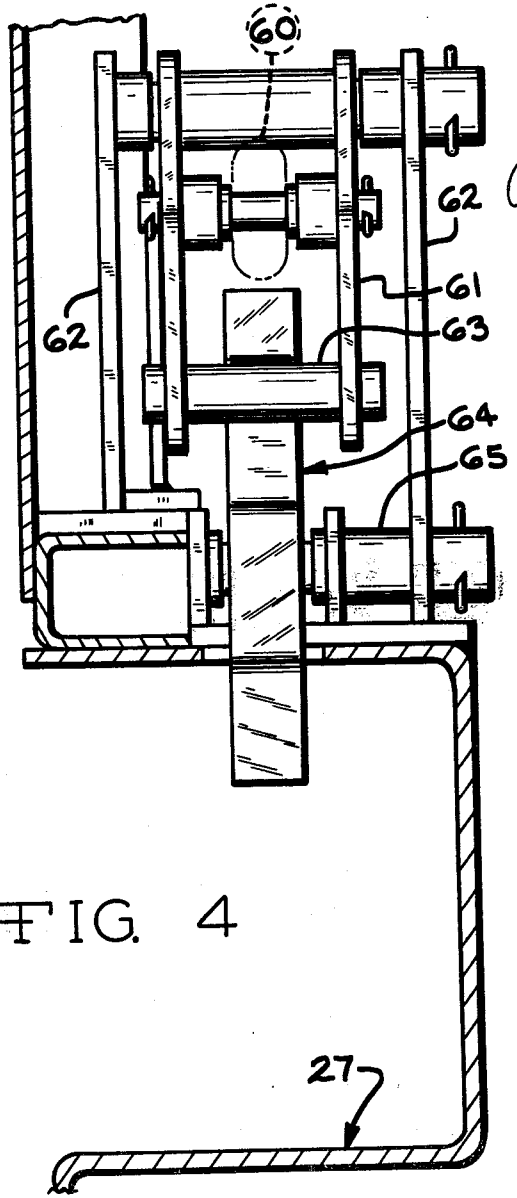
FIG. 4 is a vertical sectional view taken along the line 404 of FIG. 3.

The rocker 61 and latch plate 64 are shown in their neutral positions in FIGS. 3 and 5, in their disengaged positions in FIG. 1 and in their latched positions in FIG. 2. By comparison of these several figures it will be seen that when the handle 41 is swung in a counterclockwise direction (FIG. 5) to shift the valve spool 39*a* to the left in that figure, the rocker 61 is rotated to pull the latch pin 63 away from the latch plate 64. Conversely, when the handle 41 is swung in a clockwise direction (FIG. 5) during the second half of the packer blade cycle, in order to set the valve 39 for moving the packer blade upwardly from the broken line position 29*b* in FIG. 2 toward the rear of the truck and thus to pack refuse into the rear of the truck body 26, the latch pin 63 is swung upwardly into the notch 66 of the latch plate 64.

By reason of the engagement of the latch pin 63 in the notch 66, the bell crank 45 holds the spool 39*a* of the valve 39 at the right in FIG. 5 even through the resistance to the movement of the packer blade 29 toward its rest position by refuse being compacted against the ejector panel 34 raises the pressure in the hydraulic system above the level at which the pressure responsive detent means 39*b* has been set. As a result, full power exerted by the pump 36, for example 2000 p.s.i., is applied to compact refuse against the ejector panel 34 compressing that refuse until the packer blade 29 reaches a position just beyond the solid line position shown in FIG. 2.

As can be seen in FIG. 2, when the packer blade 29 reaches the solid line position shown in FIG. 2, the upper end of the slide 28 engages the cam surface 67 of the latch plate 64 and cams it backwardly against the bias of a spring 69 which urges the latch plate 64 into the position shown in FIGS. 3 and 5. As soon as the position of the packer blade 29 is thus sensed, the latch pin 63 is released which frees the valve 39 and, if the pressure then existing in the hydraulic circuit is above the level at which the detent means 39*b* has been set, for instance 1700 p.s.i., the detent means 39*b* releases and the centering spring 39*c* centers the valve spool 39*a* stopping the mechanism. However, if the back pressure of the refuse is less than 1700 p.s.i. when the "system hold" mechanism is released, the detent means 39*b* does not release the valve spool 39*a* and the packer blade 29 is moved to final rest position by complete retraction of the packing cylinders 31. Pressure then builds up and the detent means 39*b* releases the spool 39*a* which is centered by the spring 39*c*.

CONTROL VALVE DETAIL

Figure 6:
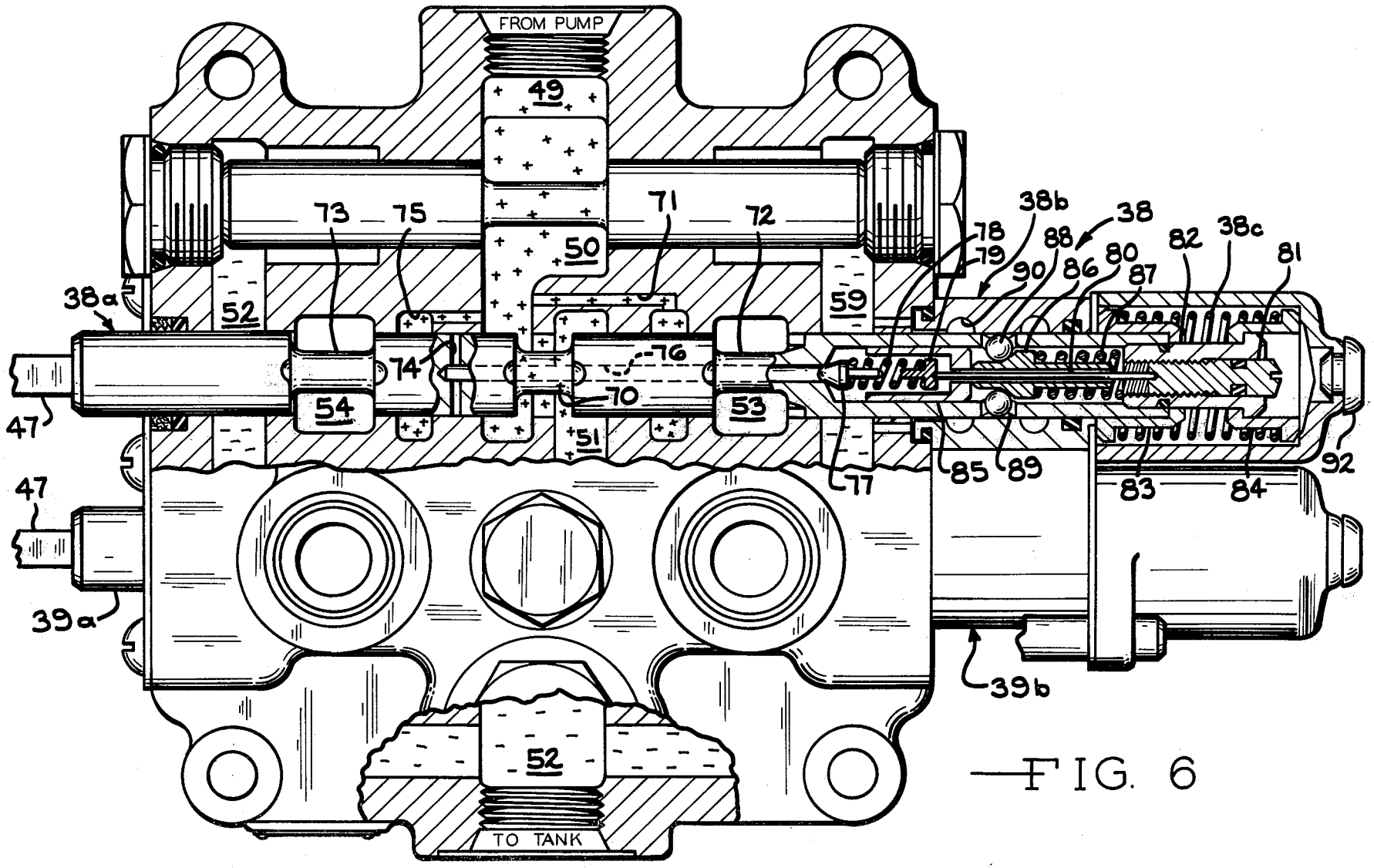
FIG. 6 is a greatly enlarged, fragmentary view, partially in vertical section, showing a control valve of the type which is conventionally employed in hydraulic circuits, and also showing a pressure responsive detent means.

Although the particular construction of the control valves 38 and 39 does not constitute a specific part of the instant invention, they must be so designed as to provide for the cooperation described above between their pressure sensing means and the position sensing mechanism or "system hold" structure which has been described. FIG. 6 is a detailed view, partly in section, showing the precise construction of the valve 38 which is illustrated as being contained in the same housing as the valve 39, but the valve 39 is not shown in section.

In FIG. 6 the valve spool 38*a* is shown in its center or neutral position and those chambers of the valve 38 in which fluid from the pump 36 is present when the valve is in neutral position are indicated by plus marks. Similarly the exhaust or low pressure chamber of the housing is indicated by minus marks. Reference numbers already used are filled into the various chambers of the housing shown in FIG. 6 so that these chambers and passageways can be related to the hydraulic lines already described with respect to FIG. 5.

When the two spools 38*a* and 39*a* are in neutral position, fluid from the pump 36 flows through the line 49 to the central unobstructed passage 50 and through an annular area around a reduced central portion 70 of the valve spool 38*a* to the passage 51 and to the outlet side of the exhaust core of the housing and the line 52 to the tank 37.

When the valve spool 38*a* is shifted to the left (FIG. 6) high pressure fluid in the passage 50 flows along a connector 71, around a reduced portion 72 of the spool 38*a* and to a passage connecting with the hydraulic line 53 to retract the sweep cylinders 33. Simultaneously, by means of a reduced portion 73 of the spool 38*a*, the line 54 from the base end of the sweep cylinders is connected to the exhaust core of the housing and to the return line 52 to the tank.

When the spool 38*a* is in this left position, a cross passage 74 in the spool 38*a* is positioned in a circular chamber 75 which communicates with the power line 49 so that the fluid under pressure is present in the cross passage 74 and, therefore, in an axial passageway 76 in the spool 38*a*. The axial passageway 76 normally is closed by a poppet 77 which is urged into sealing position by a coil spring 78 positioned between the poppet 77 and a collar 79 on a stem 80 connected to an adjustment screw 81. The poppet 77, spring 78, stem 80 and adjustment screw 81 are all located in a central core bored in the end of the spool 38*a* and the end of this core is closed by a plug 82 in which the screw 81 is threaded. The plug mounts a pair of opposed collars 83, 84 between the outer flanges of which the centering spring 38*c* is positioned.

The poppet 77 and poppet spring 78 are located in the open end of a plunger 85 which acts on a shouldered cam 86, the cam 86 being thrust against the plunger 85 by a coil spring 87 between the cam 86 and the inner end of plug 82.

Detent balls 88, of which two are shown in FIG. 6, are positioned in apertures 89 in the walls of the spool 38*a* being shown in their neutral, inoperative position in FIG. 6. When the spool 38*a* is moved to the left, as described above, the entire structure so far described also moves to the left compressing the centering spring 38*c* because the collar 84 is pulled to the left. During this movement the conical shoulder of the circular cam 86 thrusts the detent balls 88 outwardly into detent pockets 90 to retain the spool 38*a* at the left.

When the pressure in the various chambers and passageways already described as being connected to the source of fluid under pressure from the line 49 reaches the level at which the pressure responsive detent means has been set i.e. the completion of the stroke of the cylinders being moved, the pressure rises immediately and displaces the poppet 77 to the right. This immediately exposes the entire area of the plunger 85 which moves the plunger 85 and the circular cam 86 to the right allowing the balls 88 to drop into the detent apertures 89 and releasing the spool 38*a* so that the centering spring 38*c* moves it bodily to the right.

The operation of the pressure relief mechanism just described when the spool 38*a* is moved to the right is identical, with the reduced portion 72 of the spool 38*a* placing the line 53 in communication with the exhaust core and the line 52 and connecting the line 54 to the high pressure passage 50 and the pump. Simultaneously, the cross passage 74 is exposed to the center passage 50 to present the pressure fluid to the axial passageway 76.

The level at which the pressure responsive detent means 38*b* functions to release the spool 38*a* is determined by adjusting the position of the screw 81 in the plug 82. It will be observed that by the removal of a small cap 91 the end of the screw 81 is exposed and the operator can insert a screw driver to rotate it and increase or decrease the tension on the poppet control spring 78.

Having described our invention, we claim:

1. A refuse compacting apparatus comprising, in combination, (a) a compaction chamber defined by at least a floor, two side walls and a barrier extending across between said side walls which defines an end of said chamber, (b) a refuse accumulating zone communicating with the other end of said chamber, (c) a packer blade, (d) means mounting said packer blade for movement through a closed path from a refuse confining position closing the other end of said chamber for confining refuse in said chamber, to a remote position beyond said zone, and through said zone toward such confining position for moving refuse into said chamber and compacting the same against said barrier, (e) an hydraulic system comprising (1) a pump for supplying fluid to said system at a predetermined maximum system pressure, (2) a hydraulic, double acting cylinder and piston for moving said packer blade, (3) a supply line to the power side of said cylinder including a valve that is manually movable from neutral to a power position for directing fluid to said cylinder, and (4) means responsive to pressure in said supply line less than maximum system pressure for causing said valve to shift to neutral, (f) manually activated control means for holding said valve in power setting, and (g) position responsive means responsive to the position of said packer blade for de-activating said control means when said packer blade reaches a refuse confining position.

2. An apparatus according to claim 1 in which the compaction chamber is the body of a refuse truck and the refuse accumulating zone is a tailgate on the rear of said body.

3. An apparatus according to claim 1 in which the position responsive means is mechanical.

4. An apparatus according to claim 3 in which the mechanical position responsive means comprises a latch mounted on the tailgate and an actuator movable with the packer blade.

5. An apparatus according to claim 1 in which the position responsive means comprises a latch which is engaged by mechanism connected to the valve when said valve is moved to power position and a member movable with said packer blade for disengaging said latch.

6. An apparatus according to claim 1 in which the refuse accumulating zone is defined by laterally spaced, parallel vertical side walls, there is an upwardly inclined guide track in each of said side walls, the packer blade is mounted by blocks which slide in said guide tracks and the position responsive means is actuated by at least one of said blocks.

7. In an apparatus for compacting crushable material, said apparatus having, (1) an enclosure defined by at least a floor, two spaced side walls and a movable barrier which extends across between said side walls and defines one end wall of said enclosure, (2) means remote from said barrier defining a material accumulation zone that is open to the other end of said chamber, (3) a packer blade mounted for movement through said zone for moving the material therefrom and into said enclosure and for confining the material in said enclosure between said barrier and said packer blade, and (4) an hydraulic system including means for moving said packer blade and means for providing to said system hydraulic fluid at a predetermined maximum pressure, the improvement comprising, in combination, (a) manually operable hydraulic valve means in said system for supplying to said packer blade moving means hydraulic fluid at maximum system pressure, (b) pressure responsive means in said system for disabling said manually operable valve means when resistance to the movement of said packer blade generates pressure in said packer blade moving means which reaches a level less than such maximum system pressure, and (c) a manually activated position sensing device for over-controlling said pressure responsive means during movement of said packer blade toward confining position and for reactivating said pressure responsive means when said packer blade reaches a predetermined confining position.

8. An apparatus according to claim 7 in which the position sensing device and the hydraulic valve means are mechanically coupled whereby manually operating said valve means simultaneously activates said position sending means.

9. In a rear loader refuse truck having (1) a body defined by at least a floor and two spaced side walls, (2) a movable barrier which extends across between said side walls, (3) a tailgate on the rear of said body defining a material accumulation zone that is open to the rear end of said body, (4) a packer blade, (5) mechanism for mounting said packer blade for movement through said tailgate for moving refuse therefrom and into said body, and for confining the refuse in said body between said barrier and said packer blade, and (6) an hydraulic system including means for moving said packer blade and means for providing to said system hydraulic fluid at a predetermined maximum pressure, the improvement comprising, in combination, (a) manually operable hydraulic valve means in said system movable to packing position for supplying to said packer blade moving means hydraulic fluid at maximum system pressure, (b) pressure responsive means in said system for disabling said manually operable valve means when resistance to the movement of said packer blade toward said barrier generates pressure in said packer blade moving means which reaches a level less than such maximum system pressure, and (c) a position sensing device for over-controlling said pressure responsive means during movement of said packer blade toward confining position and for reactivating said pressure responsive means when said packer blade reaches a predetermined confining position, said position sensing device being activated by movement of said valve means to packing position.

10. A truck according to claim 9 in which the position sensing device comprises a latch connected to the manually operable valve means for overcontrolling the pressure responsive means and holding said valve means in packing position and an element of the packer blade mounting mechanism.

* * * * *